US005941045A

United States Patent [19]

Plehanoff et al.

[11] Patent Number: 5,941,045

[45] Date of Patent: Aug. 24, 1999

[54] CONCRETE SLAB SOCKETS

[76] Inventors: Walter Plehanoff, 7C/182 Dornoch Terrace, Highgate Hill, QLD 4101; Michael James Durack, 127 Lambert Rd., Indooroopilly QLD 4068, both of Australia

[21] Appl. No.: 08/973,616

[22] PCT Filed: May 31, 1996

[86] PCT No.: PCT/AU96/00336

§ 371 Date: Feb. 23, 1998

§ 102(e) Date: Feb. 23, 1998

[87] PCT Pub. No.: WO96/39564

PCT Pub. Date: Dec. 12, 1996

[30] Foreign Application Priority Data

Jun. 5, 1995 [AU] Australia ..... PN 3330

[51] Int. Cl.[6] ..... E04B 1/48; E04B 1/682

[52] U.S. Cl. ..... 52/704; 52/396.02; 52/583.1; 52/699

[58] Field of Search ..... 52/396.02, 704, 52/583.1, 699; 403/109.2

[56] References Cited

U.S. PATENT DOCUMENTS

| | | | |
|---|---|---|---|
| 2,187,428 | 1/1940 | Everett et al. . | |
| 2,216,979 | 10/1940 | Willis . | |
| 5,005,331 | 4/1991 | Shaw et al. | 52/396 |
| 5,216,862 | 6/1993 | Shaw et al. | 52/396 |
| 5,487,249 | 1/1996 | Shaw et al. | 52/396.02 |
| 5,579,557 | 12/1996 | Boden | 403/109.2 |
| 5,618,125 | 4/1997 | McPhee et al. | 52/396.02 |
| 5,678,952 | 10/1997 | Shaw et al. | 52/396.02 |

FOREIGN PATENT DOCUMENTS

| | | |
|---|---|---|
| 1277847 | 10/1987 | Canada . |
| 0 059 171 | 2/1982 | European Pat. Off. . |
| 2 711 163 | 5/1994 | France . |
| 1017198 | 8/1955 | Germany . |
| 2 285 641 | 7/1995 | United Kingdom . |

*Primary Examiner*—Carl D. Friedman
*Assistant Examiner*—Dennis L. Dorsey
*Attorney, Agent, or Firm*—Mathews, Collins, Shepherd & Gould, P.A.

[57] ABSTRACT

A dowel bar socket for concrete slab construction comprises a hollow elongate body (30, 31) having a mounting means (34) at a proximal end and a closed distal end (32). The socket is characterized in that the upper and lower portions of the body wall are parallel and provide a snug fit for a dowel bar to prevent movement in an upright direction. The hollow body tapers divergently from the distal end to the proximal end to permit limited lateral movement of a dowel bar as a curing concrete slab undergoes shrinking.

14 Claims, 4 Drawing Sheets

CONCRETE SLAB SOCKETS

FIELD OF THE INVENTION

This invention is related to improvements in concrete floor sockets of the type facilitating a reinforced joint between adjacently cast slabs.

BACKGROUND OF THE INVENTION

In the construction of large concrete slabs for floors and the like, it is customary to first cast a slab of a size capable of being worked by concrete finishers and then cast further slabs in abutment thereto.

After preparing the ground surface, formwork defining the peripheral edges of the slab is erected and reinforcing mesh is positioned within the formwork surround and supported above the ground surface by spacers known as "bar chairs".

In order to maintain the upper surfaces of adjacent slabs in the same plane, steel reinforcing rods known as "dowel bars" are cast into the initial slab with a portion .projecting from the side walls of that slab. When an adjacent slab is poured, the projecting portion of the dowel bar is encapsulated within the adjacent slab to resist relative movement in an upright plane between the edges of adjacent slabs. As some horizontal movement between adjacent slabs is inevitable due to thermal expansion and contraction, the free end of the dowel bar extending from the edge of a slab is coated with oil or grease to prevent adhesion in the subsequently poured adjacent slab. By allowing the dowel bar to slide within one slab during expansion or contraction, edge fractures are thereby avoided.

Dowel bars for a floor slab construction typically comprise 300 mm to 600 mm lengths of 10 to 30 mm diameter round or square section steel bar arranged at about 600 mm intervals along the edge of a previously cast slab. The dowel bars extend into each adjacent slab from 150 mm to 300 mm.

Although the dowel bars are generally effective for their intended purpose, traditional methods employed for positioning the bars in the initial slab edge are far from satisfactory in that not only are they extremely time consuming and therefore costly. They can lead to considerable frustration on the part of those engaged in slab construction.

Typically, it was customary for specialized formwork erectors to erect a timber formwork surround for a slab to be cast and then to drill apertures for the dowel bars at approximately 300 mm to 600 mm intervals. The apertures provide a neat fit to avoid leakage of concrete through these apertures when the slab is cast Another team specialised in positioning the steel reinforcing mesh then set up the necessary reinforcing structure including the steel dowel bars which protrude outwardly from the apertures in the formwork surrounds.

The main problem associated with this technique is that it is practically impossible to position the dowel bars perfectly parallel in both the upright and horizontal planes. Accordingly. after the slab has cured, extreme difficulty is incurred in removal of the formwork (usually a long timber plank) as a consequence of the non parallel array of protruding ends. To avoid loosening the dowel bars cast into the slab and also to avoid damage to the edge of the slab by attempting to lever the formwork away from the slab, it has become customary to cut the formwork between adjacent dowel bars and slide each segment over the protruding portion of the dowel bar.

Apart from being a costly waste of time and materials. this procedure is frustrating and difficult in view of the fact that the formwork extends to the ground surface thus necessitating a hole to be dug into the ground to enable an electric saw to cut all the way through the formwork.

These prior art problems have been addressed in Australian Patent Application No. 21883/95 and U.S. Pat. Nos. 5005331, 5216862 and 5487249, all of which provide a moulded plastics tubular socket of circular cross section having a closed distal end and an open proximal end with an integral or separate mounting flange to permit attachment to slab casting formwork.

While generally effective for their purpose, the dowel bars socket of the above prior art references do not accommodate slab shrinkage in a transverse direction unless the dowel bar has a lesser diameter than the internal diameter of the dowel bar socket.

In many cases this clearance does not create a problem but in certain high specification applications, the clearance between the dowel bar and Its socket, while allowing transverse shrinkage movement, also allows an unacceptable vertical displacement between a previously cast and subsequently cast slab.

Typically, for injection moulded plastics sockets of say, 300 mm in length, it is necessary to form a divergent taper on both the interior and exterior walls from the closed distal end to the open proximal end to enable removal of the moulded socket from the injection moulding die.

Thus, for a 20 mm dowel bar the internal diameter of the socket bore at the distal end may be 20.0 mm to 20.5 mm whereas the inner bore diameter at the open proximal end will be typically of the order of 21.0 mm to 22.5 mm.

Accordingly unless dowel bars are centred in respective sockets they may be capable of shrinkage movement in a lateral direction of up to 2.5 mm and similarly up to 2.5 mm in a vertical direction.

Generally speaking the loose fit of the dowel bars at the proximal end of the sockets means that they are randomly arranged and substantial variations in movement capacity can exist between adjacent dowel bars. This uneven allowance for lateral shrinkage and unacceptable allowance of relative upright movement between adjacent slabs can give rise to cracking of slabs in the region of the dowel bar as they cure and even after curing if substantial movement is permitted between slabs.

SUMMARY OF THE INVENTION

It is an aim of the present invention to overcome or alleviate at least some of the prior art problems associated with dowel bar sockets for concrete slab casting purposes.

According to the invention there is provided a dowel bar socket for concrete slab constructions, said socket comprising: a hollow elongate body having a closed distal end;

mounting means for attachment of said body to concrete slab formwork;

said socket characterised in that normally upper and lower wall portions of said body are substantially parallel and side wall portions taper divergently from said distal end towards a proximal end of said body.

Suitably said socket includes yieldable locating means associated with an inner wall surface of said body adjacent said proximal end to locate a dowel bar substantially centrally of said side wall portions.

If required said body may comprise an integral member.

Alternatively said body may comprise telescopically engageable members connecting intermediate the distal and proximal ends of the body.

Preferably the body has a closed proximal end.

Suitably the proximal end of the body is closed by a removable and/or pierceable closure member.

If required said mounting means may be integrally formed with a proximal end of said body.

Alternatively the mounting means may comprise a detachable mounting member.

Preferably the mounting member comprises a mounting flange and a hollow socket adapted to receive an open proximal end of said body.

Alternatively the mounting member comprises a mounting flange and a spigot engagable in an open proximal end of said body.

The mounting means suitably comprises at least one reinforcing web.

Preferably at least one reinforcing web includes an aperture to releasably retain a reinforcing member transverse to a longitudinal axis of said body.

BRIEF DESCRIPTION OF DRAWINGS

In order that the invention may be more fully understood and put into practical effect, reference will now be made to preferred embodiments illustrated in the accompanying drawings in which.

DETAILED DESCRIPTION

Figure 1:
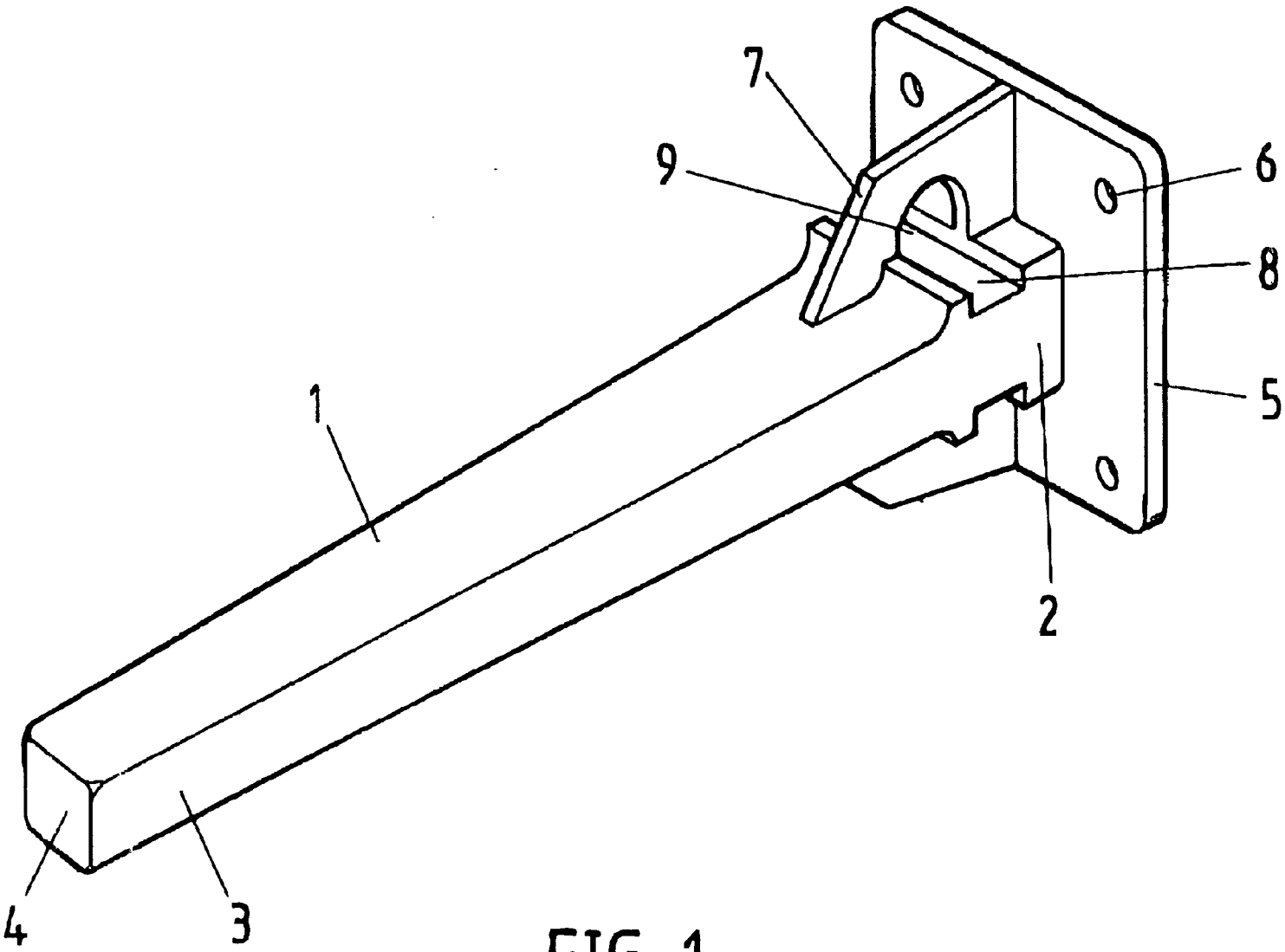
FIG. 1 illustrates a perspective view of one form of a socket according to the invention.

In FIG. 1 the socket comprises a hollow rectangular body 1 tapering convergently from a proximal end 2 to a distal end 3 which includes an end wall 4.

At proximal end 2 is a mounting flange 5 having apertures 6 for insertion of fasteners such as nails or clouts (not shown).

Reinforcing webs 7 are provided between the mounting flange 5 and the upper and lower surfaces of the body 1.

A channel shaped recess 8 is provided in the upper and lower walls of body 1, the channel shaped recesses being aligned with apertures 9 in the upper and lower webs 7, the purpose of which apertures and recesses will be described later.

Figure 2:
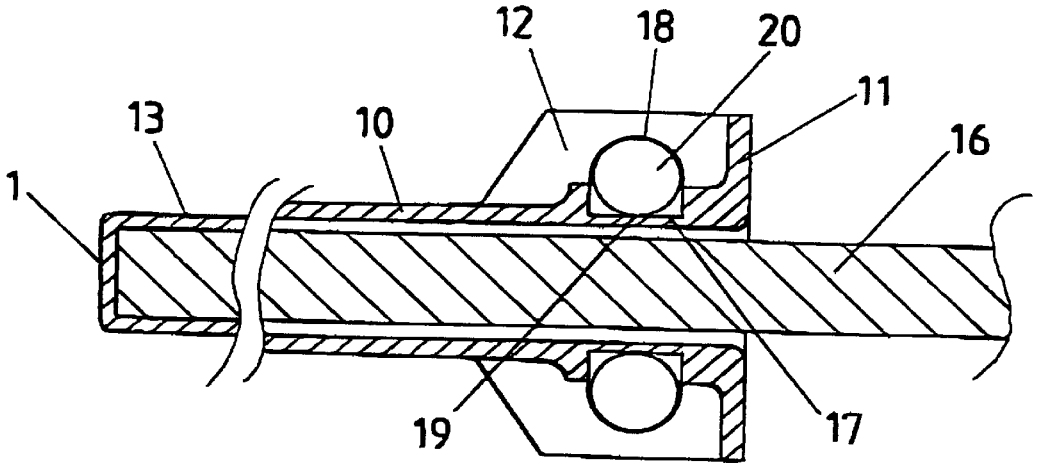
FIG. 2 illustrates a part longitudinal cross sectional view of an alternative embodiment of the invention.

FIG. 2 shows schematically an alternative embodiment of the invention.

In FIG. 2, the socket comprises a proximal end comprising a hollow body portion 10, a mounting flange 11 and reinforcing webs 12 extending between the body portion 10 and flange 11.

A distal body portion 13 comprises a tubular member closed at its distal end 15 and frictionally engageable with proximal body portion 10 to form an elongate hollow cavity within which a dowel bar 16 may be received.

Extending transversely of body portion 10 is a channel shaped recess 17 which is aligned with an aperture 18 in reinforcing web 12. Channel shaped recess 17 defines a region 19 of reduced wall thickness in body 10.

Reinforcing means in the form of steel pegs 20 are transversely located in recesses 17 and apertures 18 to resist upright forces on the socket as a result of differential upright forces between adjacently cast concrete slabs (not shown) with which the socket/dowel bar assembly is associated.

Figure 3:
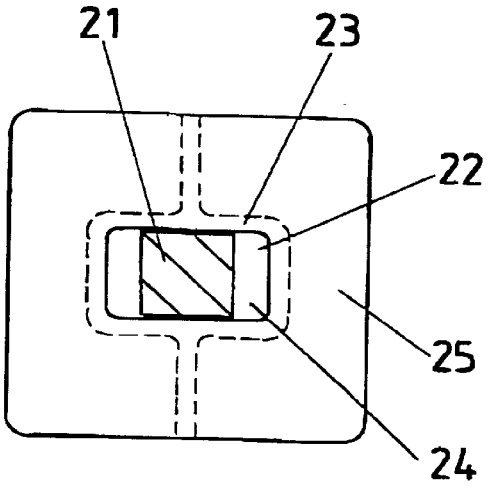
FIG. 3 illustrates an end elevation of the embodiment of FIG. 1 with a rectangular cross section dowel bar.

FIG. 3 shows an end elevation of the socket of FIG. 1 in which a square dowel bar 21 is inserted.

Across the proximal end of the interior cavity 22 of body 23 is formed a membrane 24 to form a closure in mounting flange 25. Suitably membrane 24 comprises an integrally formed yieldable wall of reduced thickness in a moulded plastics socket. Alternatively the membrane 24 comprises a yieldable plastics or metal foil or a laminate thereof adhesively attached to mounting flange 25.

Figure 4:
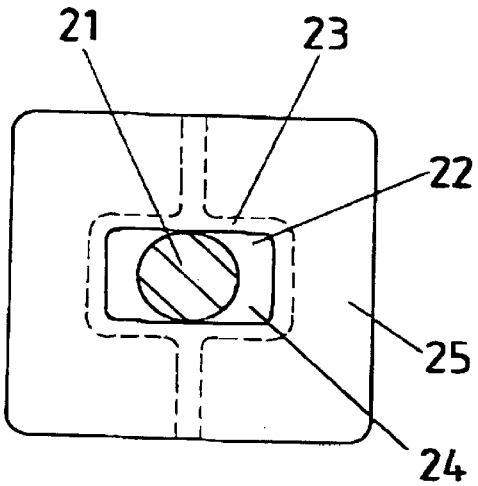
FIG. 4 illustrates an end elevation of the embodiment of FIG. 1 with a circular cross section dowel bar.

FIG. 4 shows a similar-arrangement of FIG. 3 except that a circular cross section dowel bar is inserted in the socket. For the sake of simplicity, the same reference numerals as FIG. 3 have been employed.

As shown in FIGS. 3 and 4, the thin yieldable membrane 24 associated with the mounting flange 25 permits the insertion of either a round or rectangular cross section dowel bar 21 while providing a sealable engagement with the surface of the bar 21 to prevent incursion of concrete during the pouring of an adjacent slab.

As the adjacent slab (not shown) shrinks transversely during curing, at least a limited amount of transverse movement is permitted in the dowel bar 21 without inducing stresses in the concrete surrounding the more recently poured slab which could lead to fracture. As the cavity 22 within the socket body 23 provides a neat fit of dowel bar 21 in an upright direction, relative movement between adjacent concrete slabs in an upright direction due to settling or the like is resisted.

For higher specification slabs, reinforcing means such as transverse steel bars 20 (as shown in FIG. 2), U-shaped loops or the like can be inserted in apertures 18 and cast into the initial slab as further reinforcement against upright movement.

Figure 5:
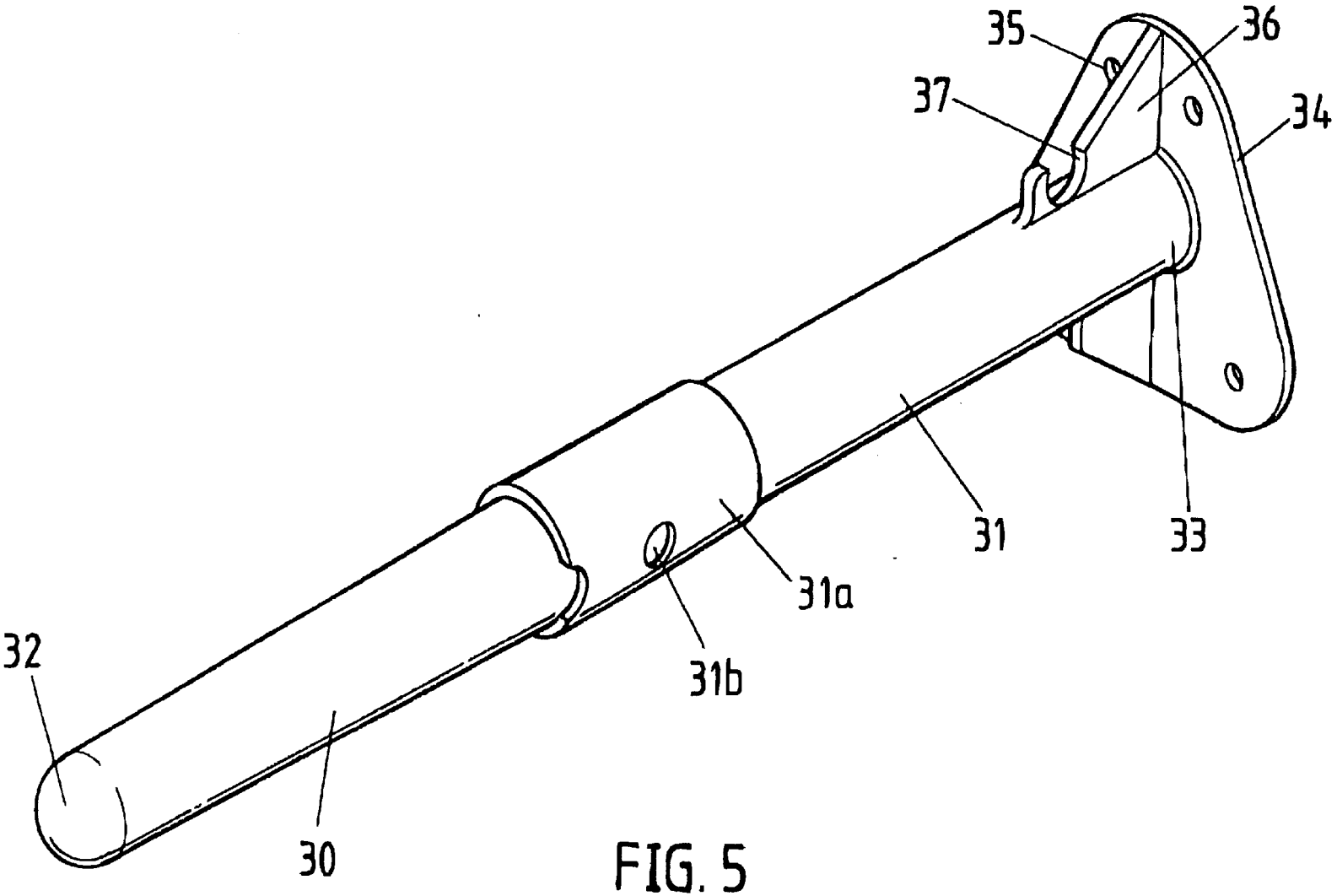
FIG. 5 shows a particularly preferred embodiment of the invention.

FIG. 5 shows a particularly preferred form of the invention.

In FIG. 5, the socket comprises separate telescopically engagable body portions 30, 31 produced by an injection moulding process. One end of the body portion 30 locates in an enlarged portion 31*a* of body portion 31 and is retained therein by a projection engaging with aperture 31*b* in portion 31*a*.

The upper and lower wall portions of the assembled body 30, 31 are substantially parallel and snugly accommodate a dowel bar (not shown) therebetween.

The opposed side wall portions of the assembled body 30, 31 diverge from the closed distal end 32 to the proximal end 33 of the socket body to define an interior aperture of a generally oval cross section adjacent the proximal end.

A mounting flange 34 is integrally formed on the proximal end of body portion 31 and, if required, apertures 35 are provided for fasteners.

An integrally formed reinforcing web 36 extends between flange 34 and body portion 31 and includes a notched aperture 37 to receive a reinforcing member (not shown) extending transversely of the longitudinal axis of the body 30, 31.

Figure 6:
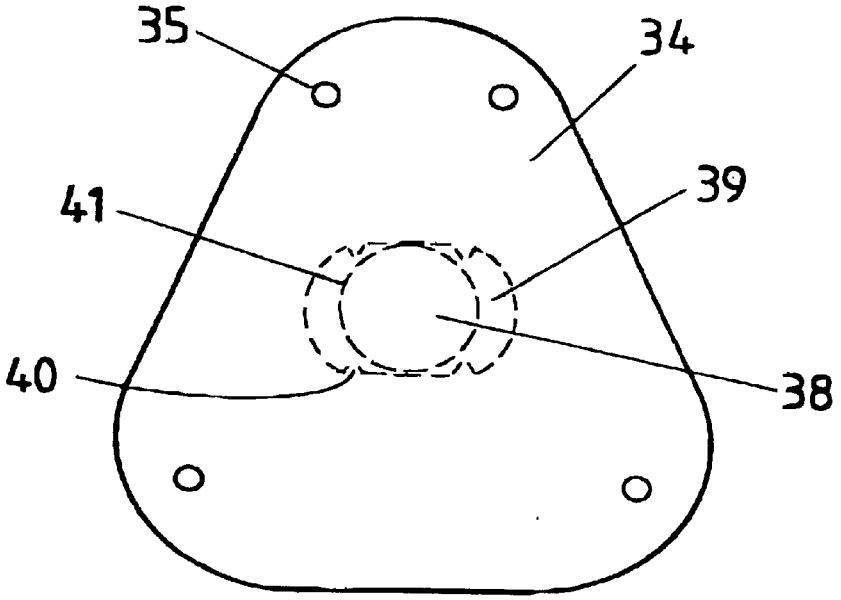
FIG. 6 shows an end elevational view of the embodiment of FIG. 5.

FIG. 6 shows an end elevational view of proximal end 33 of the socket of FIG. 5.

The end wall of flange 34 includes a closure in the form of a thin membrane 38 formed over the cross sectionally oval shaped cavity 39 shown in phantom within body portion 31.

Adjacent the membrane 38 are ribs 40 formed on the inner wall of cavity 39 to centrally locate a dowel bar 41 within the cavity.

As both body portions 30 and 31 are formed by injection moulding, the membrane 38 is formed with a peripheral weakness whereby the membrane can be readily perforated by a dowel bar yet still act to prevent ingress of wet concrete.

The ribs 40 are sufficient to locate the dowel bar centrally of the aperture 39 during pouring of concrete. As the concrete slab shrinks during curing, the ribs to yield to lateral pressures applied on the dowel bar to enable lateral movement within cavity 39.

Figure 7:
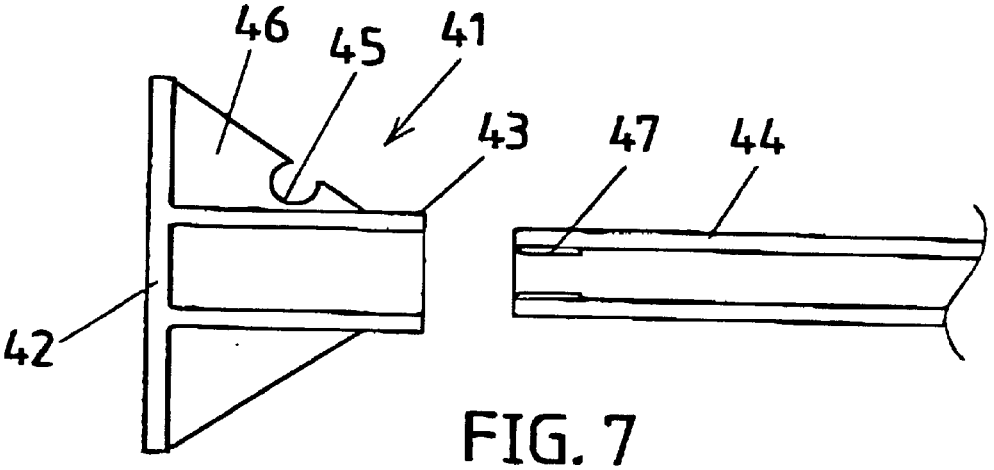
FIG. 7 shows one embodiment of a detachable mounting means.

FIG. 7 shows a cross sectional view of an alternative mounting arrangement for dowel bar sockets according to the invention.

In this arrangement the mounting means 41 comprises a separately formed mounting flange 42 having a tubular socket 43 extending normally thereto to receive an open proximal end of a socket body 44.

An aperture 45 is provided in reinforcing web 46 to receive a transversely extending load bearing member (not shown).

Although as shown the mounting flange 42 is formed as a contiguous member, it could be formed with a perforable closure member or it could have an aperture formed therein.

In order to centrally locate the dowel bar in such an arrangement, small ribs 47 are formed on the inner wall of socket body 44.

Figure 8:
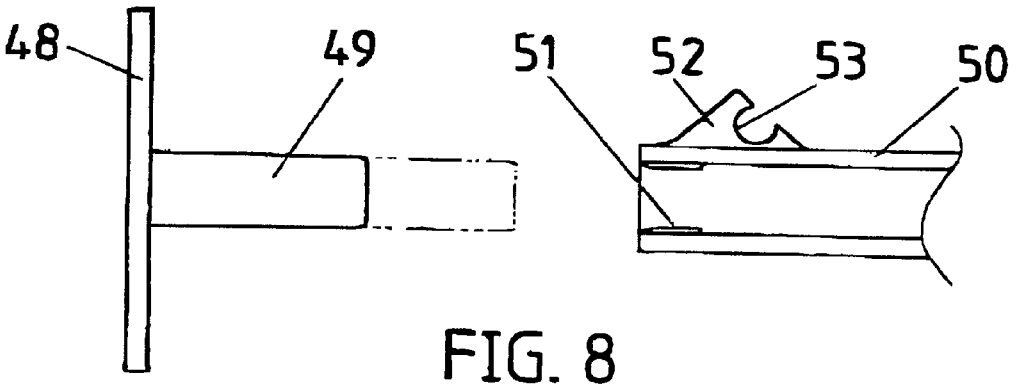
FIG. 8 shows another embodiment of a detachable mounting means.

FIG. 8 shows yet another alternative mounting means for sockets according to the invention.

In this arrangement mounting flange 48 has extending therefrom a spigot 49 adapted to engage the inner surface of a body 50. Spigot 49 may be a solid or tubular member.

The inner wall surface of body 50 has formed therein ribs 51 to centre a dowel bar and, if, required a projection 52 having a reinforcing bar locating aperture 53.

The mounting arrangement of FIG. 8 is adapted for mounting on either a front or rear side of slab formwork and if mounted on a front surface, spigot 49 is extended by an appropriate amount as shown in phantom.

Similarly, the mounting arrangement of any of the embodiments of FIGS. 1, 2, 5 and 7 could be adapted for mounting on either side of a formwork member either where the formwork is cast in situ or removed before pouring an adjacent slab. In this respect, the mounting means adapted for mounting on the front side of removable formwork are reusable.

The reinforcing means may comprise round bar sections in combination with round or square section dowel bars or for even higher specification slabs, square section transverse reinforcing bars may be used in combination with square section dowel bars for maximum load distribution.

It will be readily apparent to a skilled addressee that many modifications and variations may be made to the invention without departing from the spirit and scope thereof.

For example, the yieldable membrane closure in the proximal end may comprise a thin plerceable film or it may comprise regions of reduced thickness defining tearable circular and/or rectangular apertures.

Similarly, the apertures in the reinforcing web may each comprise a pierceable membrane or deformable aperture to firmly locate a circular or rectangular section reinforcing bar.

The socket according to the invention may also be adapted to accommodate a range of dowel bar diameters. For example the upright inner dimension of the socket body may be of 19–20 mm to accommodate a 19 mm bar.

In the event that a lower specification slab is desired with say, a 16 mm diameter bar, a larger transverse reinforcing bar may be used to cause the regions 19 of reduced thickness (FIG. 2) to deform inwardly to define a 16 mm upright internal cavity dimension.

Sockets according to the invention may be adapted to accommodate dowel bar insertion lengths of from 150–400 mm and diameters in the range 12 mm–35 mm.

The transverse dimensions of the proximal end of the body cavity may be adapted to allow a lateral clearance of from 2 mm–6 mm on each side of a centrally located dowel bar.

The reinforcing bars, whether circular or rectangular may have a diameter in the range of from 10–16 mm and be of any suitable length depending upon reinforcing requirements for the slab.

The sockets may be made by any suitable process such as injection moulding of plastics materials including polyolefins, nylons, ABS or the like. Suitably, the sockets are manufactured from reclaimed plastics for cost considerations.

The sockets may be separately formed as distal and proximal elements which are telescopically engageable and secured frictionally or by an adhesive or by fusion.

Alternatively the sockets may be formed with longitudinally extending joints engageable by socket and spigot means, fused wall joints or fused wall flanges.

The socket and spigot joints, wall flanges or the like may be shaped to provide a means for retention in an initially cast slab or the socket may include outwardly extending projections or inwardly extending cavities to resist withdrawal from a cast concrete slab.

Suitably the sockets are formed with longitudinally extending reinforcing webs extending over substantially the length of the socket.

We claim:

1. A dowel bar socket for concrete slab constructions, said socket comprising a hollow elongate body having a closed distal end;

mounting means for attachment of said body to concrete slab formwork;

said socket characterized in that the cross sectional shape of a hollow cavity within said body adjacent a proximal end has a dimension in a transverse direction greater than a dimension in an upright direction wherein, in use, at least limited transverse movement of a dowel bar is permitted in a proximal end of said socket while substantially resisting movement in an upright direction of said dowel bar in said proximal end of said socket.

2. A socket as claimed in claim 1 including yieldable locating means associated with an inner wall surface of said body adjacent said proximal end to locate a dowel bar substantially centrally of said side wall portions.

3. A socket as claimed in claim 1 wherein said body comprises an integral member.

4. A socket as claimed in claim 1 wherein said body comprises telescopically engagable members connecting intermediate the distal and proximal ends of the body.

5. A socket as claimed in claim 1 wherein the body has a closed proximal end.

6. A socket as claimed in claim 5 wherein the proximal end of the body is closed by a removable and/or pierceable closure member.

7. A socket as claimed in claim 1 wherein said mounting means is integrally formed with a proximal end of said body.

8. A socket as claimed in claim 7 wherein the mounting member comprises a mounting flange and a hollow socket adapted to receive an open proximal end of said body.

9. A socket as claimed in claim 7 wherein the mounting member comprises a mounting flange and a spigot engagable in an open proximal end of said body.

10. A socket as claimed in claim 1 wherein the mounting means comprises a detachable mounting member.

11. A socket as claimed in claim 10 wherein the mounting member comprises a mounting flange and a hollow socket adapted to receive an open proximal end of said body.

12. A socket as claimed in claim 10 wherein the mounting member comprises a mounting flange and a spigot engagable in an open proximal end of said body.

13. A socket as claimed in claim 1 wherein the mounting means comprises at least one reinforcing web.

14. A socket as claimed in claim 13 wherein at least one reinforcing web includes an aperture to releasably retain a reinforcing member transverse to a longitudinal axis of said body.

* * * * *